US006915613B2

(12) United States Patent
Wostal et al.

(10) Patent No.: US 6,915,613 B2
(45) Date of Patent: Jul. 12, 2005

(54) COLLAPSIBLE CONCRETE FORMS

(75) Inventors: Terry K. Wostal, Baraboo, WI (US); Steven J. Paske, Baraboo, WI (US)

(73) Assignee: Cellox LLC, Reedsburg, WI (US)

( * ) Notice: Subject to any disclaimer, the term of this patent is extended or adjusted under 35 U.S.C. 154(b) by 0 days.

(21) Appl. No.: 10/404,748

(22) Filed: Apr. 1, 2003

(65) Prior Publication Data

US 2004/0103609 A1 Jun. 3, 2004

Related U.S. Application Data

(60) Provisional application No. 60/430,176, filed on Dec. 2, 2002.

(51) Int. Cl.[7] ..... E04B 2/86; E04C 1/00

(52) U.S. Cl. ..... 52/426; 52/591.2; 52/592.6

(58) Field of Search ..... 249/44, 45, 47, 249/192, 195, 196, 33, 190, 213, 216; 52/426, 427, 428, 442, 562, 565, 568, 591.2, 592.1, 592.6

(56) References Cited

U.S. PATENT DOCUMENTS

| | | | | | |
|---|---|---|---|---|---|
| 1,700,889 | A | * | 2/1929 | Heltzel | 249/4 |
| 2,400,852 | A | * | 5/1946 | Stevenson | 249/33 |
| 2,524,634 | A | * | 10/1950 | Oscar | 33/404 |
| 2,641,043 | A | * | 6/1953 | Martin | 219/192 |
| 3,985,329 | A | * | 10/1976 | Liedgens | 249/216 |
| 4,229,920 | A | | 10/1980 | Lount | |
| 4,706,429 | A | | 11/1987 | Young | |
| 4,765,109 | A | | 8/1988 | Boeshart | |
| 4,866,891 | A | | 9/1989 | Young | |
| 4,889,310 | A | | 12/1989 | Boeshart | |
| 4,901,494 | A | * | 2/1990 | Miller et al. | 52/426 |
| 5,323,578 | A | * | 6/1994 | Chagnon et al. | 52/426 |
| 5,390,459 | A | | 2/1995 | Mensen | |
| 5,809,727 | A | | 9/1998 | Mensen | |
| 5,887,401 | A | | 3/1999 | Moore, Jr. | |
| 5,890,337 | A | | 4/1999 | Boeshart | |
| 6,170,220 | B1 | | 1/2001 | Moore, Jr. | |
| 6,224,031 | B1 | | 5/2001 | Boeshart | |
| 6,230,462 | B1 | | 5/2001 | Béliveau | |
| 6,256,962 | B1 | | 7/2001 | Boeshart | |
| 6,314,697 | B1 | | 11/2001 | Moore, Jr. | |
| 6,318,040 | B1 | | 11/2001 | Moore, Jr. | |
| 6,336,301 | B1 | | 1/2002 | Moore, Jr. | |
| 6,363,683 | B1 | | 4/2002 | Moore, Jr. | |
| 6,401,419 | B1 | * | 6/2002 | Beliveau | 52/592.6 |
| 6,438,918 | B2 | | 8/2002 | Moore, Jr. et al. | |
| 6,481,178 | B2 | | 11/2002 | Moore, Jr. | |
| 6,526,713 | B2 | | 3/2003 | Moore, Jr. | |
| 6,668,503 | B2 | * | 12/2003 | Beliveau | 52/426 |

* cited by examiner

*Primary Examiner*—Michael Safavi
(74) *Attorney, Agent, or Firm*—Craig A. Fieschko, Esq.; DeWitt Ross & Stevens S.C.

(57) ABSTRACT

A concrete form unit includes opposing sidewalls which are preferably made of foamed plastic or other insulating material. Articulated spacers extend between and connect the sidewalls, and are capable of folding about themselves both at an elbow situated between the sidewalls, and also at their junctures with the sidewalls. The folding ability of the spacers allow the sidewalls to convert between a collapsed state wherein the sidewalls are in close adjacent relationship and the spacer links are oriented at least substantially parallel to each other and at least substantially parallel to the sidewalls, and an expanded state wherein the sidewalls are in distant spaced relationship with the spacer links being oriented at least substantially parallel to each other and at least substantially perpendicular to the sidewalls. The collapsed form unit therefore assumes an overall box-like shape, and therefore the collapsed form units are easily stored and shipped with minimal lost storage volume.

28 Claims, 3 Drawing Sheets

COLLAPSIBLE CONCRETE FORMS

CROSS-REFERENCE TO RELATED APPLICATIONS

This application claims priority under 35 USC §119(e) to U.S. Provisional Patent Application 60/430,176 filed 2 Dec. 2002, the entirety of which is incorporated by reference herein.

FIELD OF THE INVENTION

This document concerns an invention relating generally to concrete forms for casting poured concrete, and more specifically to insulated concrete forms (commonly referred to as "ICFs") wherein the forms include inner and outer insulated sidewalls which receive poured concrete therebetween.

BACKGROUND OF THE INVENTION

The construction industry has experienced a growing trend in the use of insulated concrete forms (ICFs), wherein forms for pouring concrete are constructed from multiple modular form units. Each unit includes inner and outer sidewalls, at least one of which is formed of foamed polystyrene, foamed polyurethane, or other cellular plastics or insulating materials. The sidewalls of the form units are stacked or otherwise interconnected at the construction site to form opposing insulated inner and outer form walls between which concrete is poured. The insulated form walls are then left with the poured concrete at the site to define a portion of the poured concrete wall(s) of the structure being constructed, resulting in concrete walls with insulated surfaces. Examples of insulated concrete forms and form units of this nature can be found, for example, in U.S. Pat. Nos. 4,706,429 and 4,866,891 to Young; U.S. Pat. Nos. 4,765,109 and 4,889,310 to Boeshart; U.S. Pat. Nos. 5,390,459 and 5,809,727 to Mensen; and U.S. Pat. No. 6,314,697 to Moore.

As these patents illustrate, it is common to have each sidewall of a form unit bear tongue-and-groove structures (or other interfitting structures) at its edges so that the inner sidewall of each form unit can be interfit at its edges to inner sidewalls of other form units, thereby allowing the inner sidewalls to be combined to form an inner wall of a concrete form. The outer sidewalls can likewise include interfitting structure allowing them to be combined into an outer form wall. Additionally, the inner and/or outer sidewalls often include "webs," structures which are generally formed of plastic and which extend within and engage the foamed insulating material of the sidewalls. Connecting members which are often referred to as "ties" or spacers then extend between the inner and outer sidewalls and engage their webs to hold the sidewalls in opposing parallel relationship. When the concrete is poured between the sidewalls to solidify, the ties are left embedded within the concrete and maintain the insulated sidewalls as cladding on the opposing sides of the concrete wall.

While form units and forms of the foregoing nature are beneficial in that they conveniently use the forms for casting the concrete walls as insulating cladding for the walls, and they eliminate any need to disassemble or remove the forms after the walls are poured, they suffer from the disadvantage that their form units—being formed of a pair of sidewalls (generally foamed of bulky foamed plastic) joined by spacers—occupy substantial volume, and are therefore expensive to ship. Some of the aforementioned patents address this disadvantage by providing detachable/reattachable spacers which rigidly but disconnectably affix the sidewalls together. Such form units allow users to provide sidewalls and spacers separately, whereby the sidewalls of each form unit are stacked and shipped separate from the spacers (and thus without including a wasted intermediate space between the sidewalls), and each form unit can then be assembled at the construction site by fastening the spacers between the sidewalls. However, these forms trade shipping costs for labor costs, since hundreds or even thousands of spacers must be installed between the sidewalls to construct the form units and forms.

To overcome the foregoing difficulties, some ICF manufacturers have developed concrete form units wherein the spacers are pivotally affixed to their opposing sidewalls, with the various spacers thereby effectively form parallelogram linkages with the sidewalls. As a result, the sidewalls can be brought together (their intermediate space may be eliminated) by moving the sidewalls in opposing longitudinal directions. Examples of such arrangements are found in U.S. Pat. No. 3,985,329 to Liedgens, and U.S. Pat. Nos. 6,230,462 and 6,401,419 to Beliveau. Form units of this nature are useful because the concrete form units may be collapsed (their sidewalls may be brought into closely spaced relationship with the intermediate space eliminated), and the form units may be stacked in close relationship for shipping. The form units may then be readily unloaded at the construction site, unfolded to their expanded states, and assembled to construct larger concrete forms. However, these are disadvantageous in that the parallelogram linkage arrangement gives rise to "racking": the sidewalls, when collapsed, are offset and do not rest end-to-end, and therefore generate unused volume which is effectively wasted during shipping. This is undesirable since the form units are already quite bulky, and expensive to ship. Additionally, while users need not install the spacers between the sidewalls because the spacers are already pivotally affixed therebetween, the expanded form units are subject to buckling because the spacers do not rigidly situate the sidewalls in spaced relation. Such buckling can lead to difficulties, particularly when using the concrete form units to construct a larger concrete form.

SUMMARY OF THE INVENTION

The invention involves concrete form units and concrete forms which at least partially address the aforementioned problems. To give the reader a basic understanding of some of the advantageous features of the invention, following is a brief summary of preferred versions of the concrete form units. As this is merely a summary, it should be understood that more details regarding the preferred versions may be found in the Detailed Description set forth elsewhere in this document. The claims set forth at the end of this document then define the various versions of the invention in which exclusive rights are secured.

Referring to FIG. 1 so that the following arrangement is more readily envisioned, a concrete form unit includes opposing sidewalls which are preferably made of foamed plastic or other insulating material. Webs are embedded within the sidewalls, with protruding web portions extending out of the sidewalls into a space located between the sidewalls. Spacers extending between and connecting the sidewalls each include a pair of rigid spacer links, each spacer link including a wall end pivotally linked to a sidewall at a protruding web portion, and an elbow end pivotally linked to the other of the spacer links within the spacer. The pivotable connections of the spacer links allow the sidewalls to convert between a collapsed state wherein the sidewalls are in close adjacent relationship and the spacer links are oriented at least substantially parallel to each other and at least substantially parallel to the sidewalls (FIG. 4), and an expanded state wherein the sidewalls are in distant spaced relationship with the spacer links being oriented at least substantially parallel to each other and at least substantially perpendicular to the sidewalls (FIGS. 1 and 2). Each concrete form unit has sidewalls configured with opposing top and bottom ends, and also opposing side ends, wherein the top ends are configured to abut the bottom ends of the sidewalls of another concrete form unit in interlocking relationship. As a result of the foregoing arrangement, concrete form units may be shipped in their collapsed state, converted to their expanded state at a construction side, and stacked in interlocking form to construct a larger concrete form for the casting of large walls and other structures. The use of spacers having dual pivoting spacer links allows a form unit to collapse with the adjacent side ends of the sidewalls being situated in coplanar relationship (FIG. 4), with the collapsed form unit assuming an overall box-like shape, and therefore the collapsed form units are easily stored and shipped with minimal lost storage volume.

The concrete form units preferably include some form of stabilizing means for assisting in maintaining the form units in their expanded states without buckling. Such stabilizing means may take the form of stops situated on the elbow ends of the spacer links which allow the spacer links to pivot from the collapsed position, but which interfere with each other once the spacer links achieve the expanded state, and do not allow further pivoting thereafter (save for pivoting back to the collapsed state). If desired, the stops may further bear latching structures which then resist pivoting back to the collapsed state. The stabilizing means may additionally or alternatively take the form of latching structures on the spacer link wall ends and/or on the protruding web portions to which the spacer link wall ends are pivotally connected, so that the spacer links may rotate with respect to the sidewalls to the expanded state, but resist further pivoting out of the expanded state. This can be done, for example, by providing the spacer link wall ends with corners which interfere with the sidewalls about which they pivot, the corners being oriented such that the spacer links initially resist pivoting into the expanded state owing to interference between the corners and the sidewalls (or their protruding web portions). However, once the spacer links are urged into the expanded state, this interference will also resist the pivoting of the spacer links out of the expanded state, and thus the spacer links will be resiliently "clicked" into the expanded state. By use of the stabilizing means, a user may set concrete form units in their expanded states, and use them to assemble a larger concrete form, without the inconvenience of having form units which are prone to buckling towards their collapsed states when working with them.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
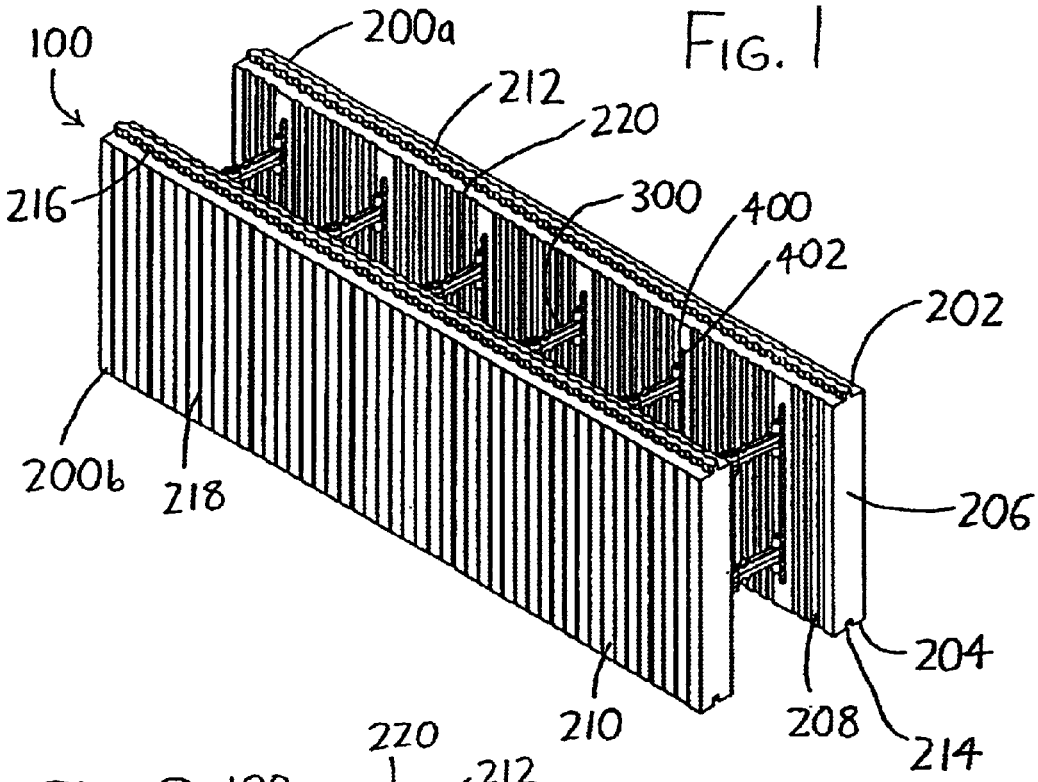
FIG. 1 is a perspective view showing an exemplary version of a concrete form unit 100 in its expanded state, wherein its sidewalls 200*a* and 200*b* are in distantly spaced relation.

Referring particularly to FIGS. 1–4, an exemplary preferred version of a collapsible concrete form unit is depicted generally by the reference numeral 100. The concrete form unit 100 includes sidewalls 200*a* and 200*b* (hereinafter collectively referred to as sidewalls 200) between which concrete is to be poured when the concrete form unit 100 is used within a concrete form (i.e., when multiple concrete form units 100 are assembled into a completed concrete form). The concrete form unit 100 additionally includes spacers 300, which serve to hold the sidewalls 200 in spaced relation during the pouring and setting of concrete therebetween. As will be discussed in greater detail below, the concrete form unit 100 is collapsible from the expanded state (illustrated in FIGS. 1 and 2) to a collapsed state (illustrated in FIG. 4), with the spacers 300 being articulated to hingedly fold between the expanded and collapsed states. This transition can be partially envisioned with reference to FIG. 3, which shows a spacer 300 between the sidewalls 200*a* and 200*b* in a state between the expanded and collapsed states. The structure of the sidewalls 200 and spacers 300 will now be discussed in greater detail.

Looking particularly to FIG. 1, each sidewall 200 includes a sidewall top end 202, an opposing sidewall bottom end 204, and opposing sidewall side ends 206 situated between the top and bottom ends 202 and 204. These various surfaces are all situated between a sidewall inner surface 208 and a sidewall outer surface 210. The sidewalls 200*a* and 200*b* are preferably identically structured, or more accurately are symmetrically structured in mirror-image fashion with their sidewall inner surfaces 208 facing each other. Since the sidewalls 200 are to provide the primary insulating function of an insulating concrete form (ICF) system, the sidewalls 200 are preferably formed of foamed polystyrene, foamed polyurethane, or other cellular plastics, though the sidewalls 200 might be formed of other or additional materials.

Figure 2:
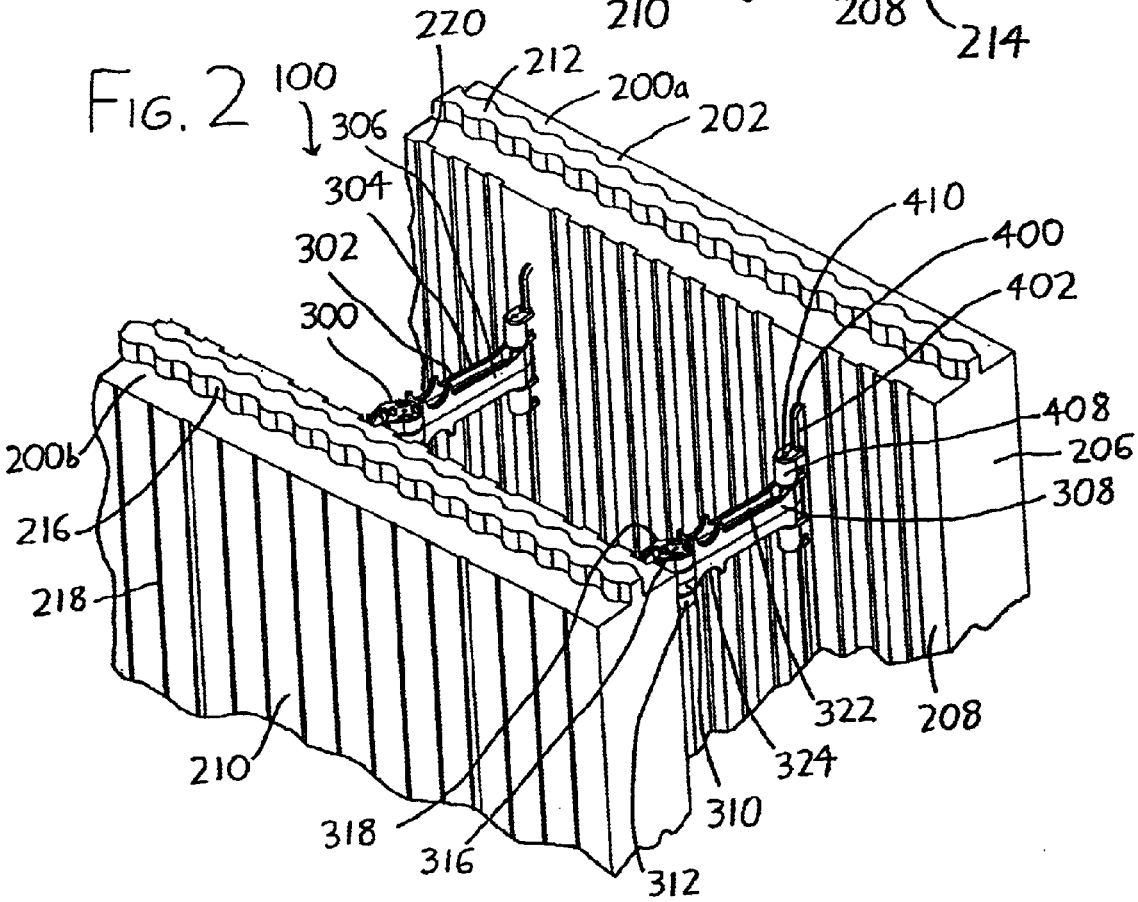
FIG. 2 is an enlarged perspective view of a portion of the concrete form unit 100 of FIG. 1, illustrating in greater detail the spacers 300 extending between the sidewalls 200*a* and 200*b*.

Looking particularly to FIGS. 1 and 2, the sidewall top and bottom ends 202 and 204 are configured such that sidewall top end 202 of one concrete form unit 100 may abut the sidewall bottom end 204 of another concrete form unit 100 in interlocking relationship, with the sidewall top end 202 here bearing a tongue 212 and the sidewall bottom end 204 bearing a complementary groove 214. As can be best seen in FIGS. 2 and 3, the tongue 212 (and thus the groove 214) is defined between sinuous/zig-zagged tongue sidewalls 216, which assist in preventing interlocked concrete form units 100 from shifting longitudinally (i.e., parallel to the plane of the sidewalls 200) when the concrete form units 100 are stacked in interfitting relationship.

Figure 3:
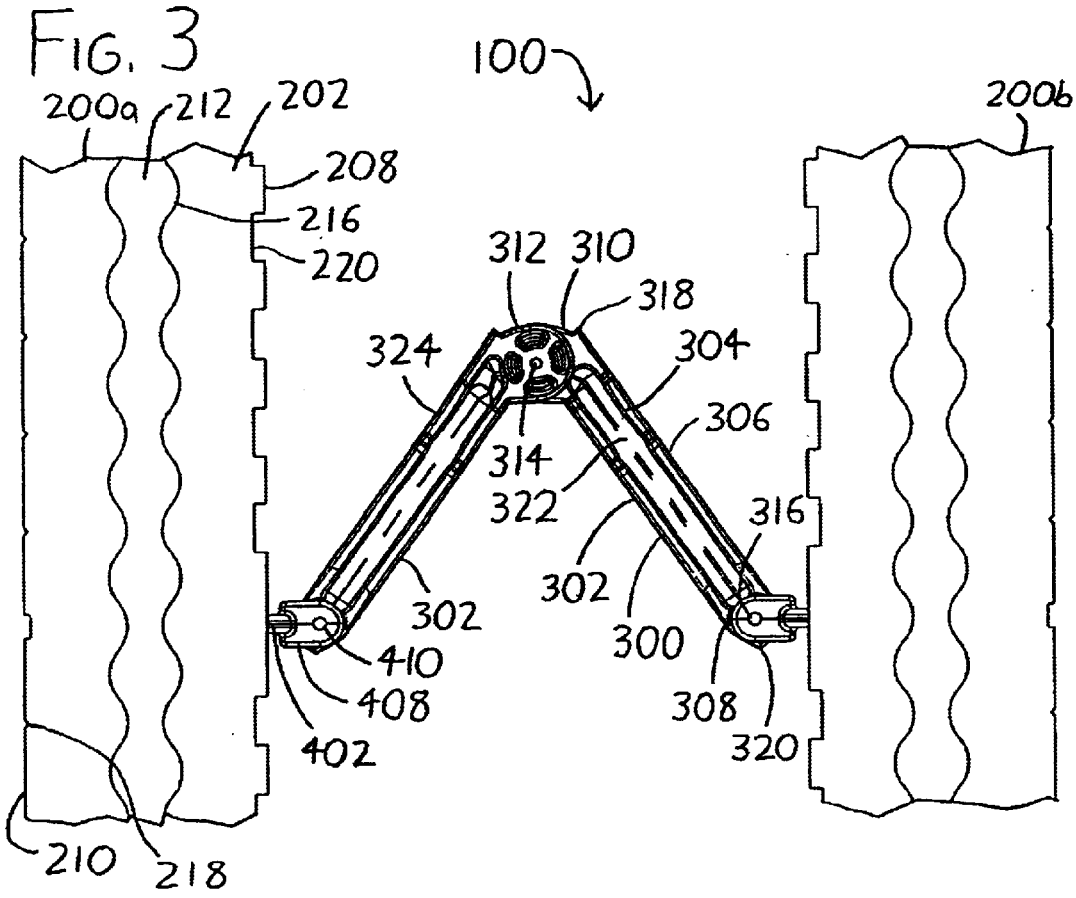
FIG. 3 is a top plan view of a portion of the concrete form unit 100 of FIG. 1 showing a spacer 300 in a partially collapsed state.

As best shown in FIG. 1, the sidewall outer surface 210 includes outside marking grooves 218 defined therein at regular intervals, e.g., at one inch intervals. Turning then to FIGS. 2 and 3, outside marking grooves 218 which are larger, or outside marking grooves 218 which otherwise have a different or distinctive appearance, may be provided at greater length increments (e.g., every eight inches) to allow users to easily measure distances along the sidewall outer surfaces 210. Similarly, looking particularly to FIG. 2, the sidewall inner surface 208 bears inside marking grooves 220, but here the grooves 220 all have a wider channel-like form, thereby providing an irregular surface about which concrete may flow to enhance the adhesion between the concrete and the sidewall inner surfaces 208.

Looking to FIGS. 2 and 3, the series of inside marking grooves 220 is periodically interrupted at regions wherein webs 400 protrude from the sidewalls 200. These webs 400, an exemplary one of which is illustrated in FIG. 5, are embedded within the sidewalls 200 to provide anchors for connection of the spacers 300 to the sidewalls 200 (as seen in FIGS. 1–4). Referring particularly to FIG. 5, the webs 400 include web portions 402 which protrude from the inner surfaces 208 of the sidewalls 200 (and which are shown protruding in this fashion in FIGS. 1–4); an opposing anchoring plate 404, which assists both in anchoring the webs 400 within the sidewalls 200 and which also serves as an attachment surface for fasteners driven into the sidewalls 200 from their outer surfaces 210 (as will be discussed in greater length below); and bridge members 406 which extend between the protruding web portions 402 and the anchoring plate 404 at spaced intervals.

The anchoring plate 404 is embedded within a sidewall 200 a short distance from the sidewall outer surface 210 and is oriented parallel to the sidewall outer surface 210, so that a fastener driven within the sidewall outer surface 210 towards an anchoring plate 404 will readily encounter and engage an anchoring plate 404. The anchoring plates 404 preferably have widths which at least approximate the widths of standard furring strips used in construction—preferably at least one to two inches wide—to allow easy attachment of drywall, siding anchors, or other structures to the sidewalls 200 by simply driving a fastener through these structures, and then into the sidewall outer surfaces 210 and the anchoring plates 404 therein. The locations of the anchoring plates 404 are preferably indicated by wider (or otherwise distinctive) outside marking grooves 218 so that a user may readily tell where an embedded anchoring plate 404 is situated adjacent the outer surface 210 of a sidewall 200.

The bridge members 406 of the webs 400 are spaced at intervals, thereby allowing the foamed polystyrene (or other material of the sidewalls 200) to flow about and between the bridge members 406 when the sidewalls 200 are formed. This arrangement provides better anchoring of the webs 400 within the sidewalls 200. Additionally, since the bridge members 406 are spaced apart, they leave a major portion of the length of the anchoring plate 404 unobstructed so that fasteners may be easily driven through most of the length of the anchoring plate 404.

Figure 6:
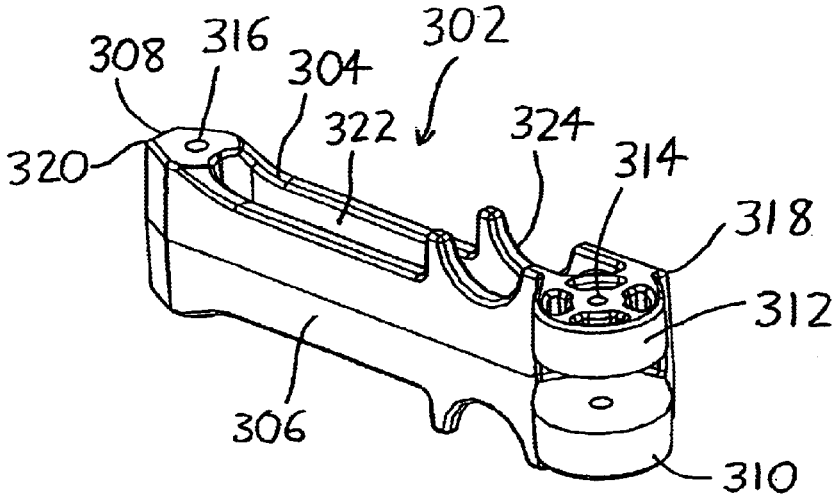
FIG. 6 is a perspective view of a spacer link 302 (two of which are combined to form a spacer 300 as illustrated in FIGS. 1–4).

Prior to discussing the structure and function of the protruding web portions 402 in greater detail, it is first useful to discuss the spacers 300. Referring particularly to FIG. 3, the spacers 300 include a pair of rigid spacer links 302 which are pivotally linked to each other and also to the protruding web portions 402. Each spacer link 302 includes a top surface 304, an opposing bottom surface (not shown in FIG. 3), and opposing side surfaces 306, all of which extend between a wall end 308 pivotally connected to one of the protruding web portions 402 of the webs 400, and an opposing elbow end 310 pivotally linked to the other spacer link 302 within the spacer 300. FIG. 6 depicts one of the spacer links 302 in greater detail. Each spacer 300 includes two such spacer links 302 having identical structure (for ease of manufacture), with the spacer links 302 then being pivotally joined at their elbow ends 310. The elbow end 310 of each spacer link 302 is yoked into a pair of spaced sleeve bearings 312, allowing the bearings 312 of the spacer links 302 to be interleaved (as best seen in FIG. 2) so that within each spacer 300, each spacer link 302 has at least one of its bearings 312 received between a pair of bearings 312 of the other spacer link 302. A bore 314 is centrally defined within the sleeve bearings 312 so that when the spacer links 302 are interleaved in the foregoing manner, a hinge pin (not shown) may be inserted to pivotally join the spacer links 302 together. With appropriate selection of materials for the spacer links 302 and the hinge pin (with the spacer links 302 preferably being formed of a high-density plastic and the hinge pin being formed of metal), assembly of the spacers 300 may be rapidly accomplished by use of a nail gun or similar device to shoot the hinge pins within the bores 314, with the hinge pins thereafter being maintained within the bores 314 by friction. While such assembly is preferably performed at the site of manufacture, it might instead be performed in the field (at the construction site) if necessary. Frictional retention of the hinge pins within the axial bores 314 may be further assisted if the surface of each hinge pin is knurled or otherwise made irregular.

The opposite wall ends 308 of the spacer links 302 are received between pairs of web sleeve bearings 408 situated on the protruding web portions 402. The web sleeve bearings 408 include bores 410 allowing insertion of a hinge pin (not shown) into a coaxial bore 316 situated in the wall end 308 of the spacer links 302, in an arrangement similar to that used to pivotally connect the elbow ends 310 of the spacer links 302.

Figure 4:
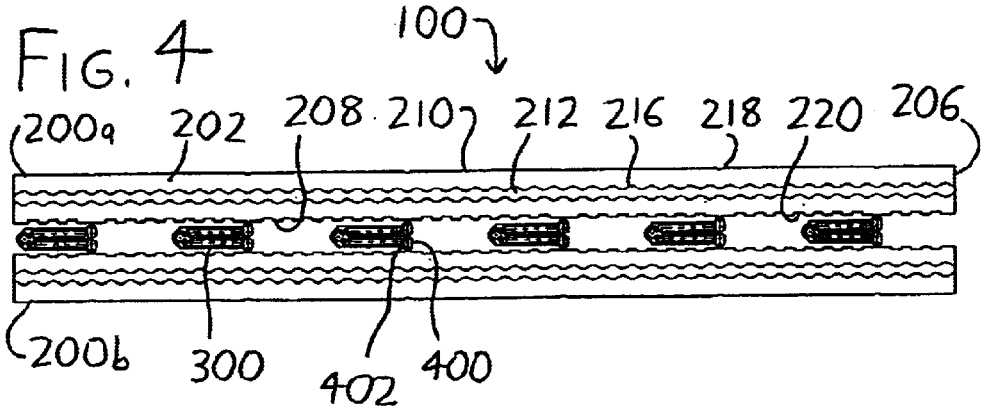
FIG. 4 is a top plan view of the concrete form unit 100 of FIG. 1 shown in a fully collapsed state, with its sidewalls 200*a* and 200*b* in closely spaced relation.
Figure 5:
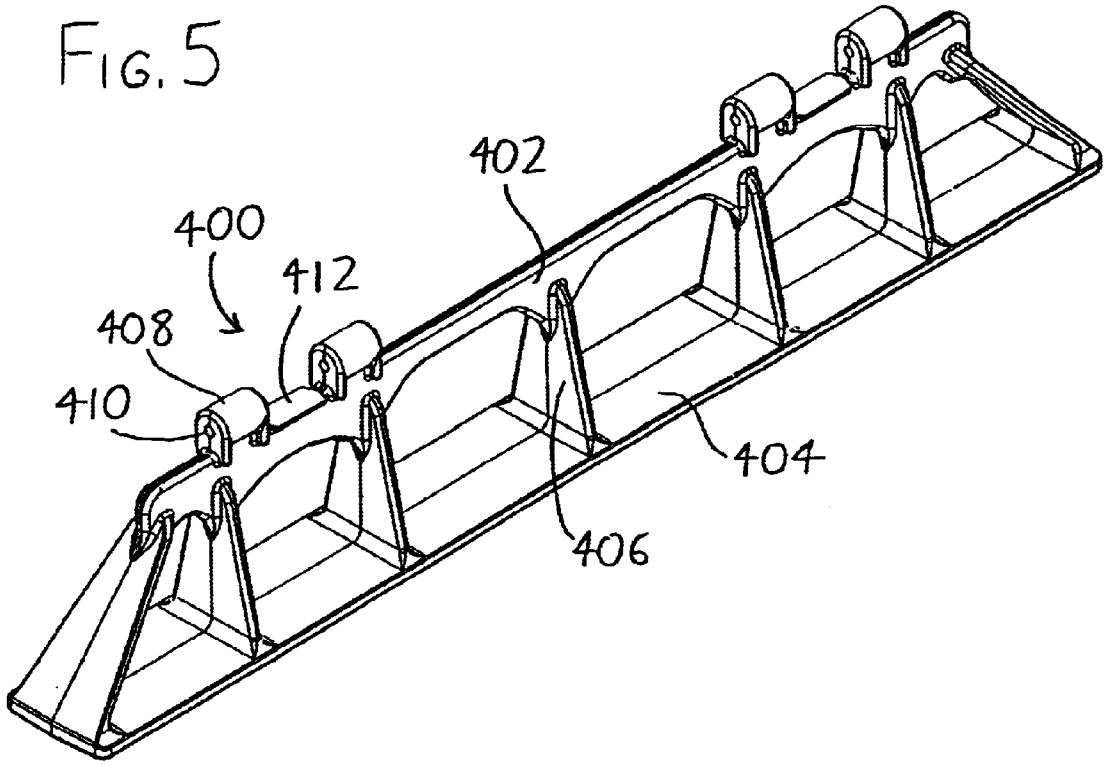
FIG. 5 is a perspective view of a web, several of which are partially embedded in the sidewalls 200*a* and 200*b* in FIGS. 1–4 to serve as connection points for spacers 300.

As a result of the foregoing arrangement, the spacer links 302 pivot with respect to the sidewalls 200 at their protruding web portions 402, and the spacer links 302 additionally pivot with respect to each other at their elbow ends 310, allowing the sidewalls 200 to move between an expanded state (illustrated in FIGS. 1 and 2) and a collapsed state (illustrated in FIG. 4). In the expanded state (see particularly FIG. 2), the sidewalls 200 are distanced into spaced relationship wherein the spacer links 302 (and the spacers 300 overall) are oriented at least substantially perpendicular to the inner surfaces 208 of the sidewalls 200. In the collapsed state (FIG. 4), the sidewalls 200 are collapsed into closely adjacent relationship wherein the spacer links 302 are oriented at least substantially parallel to the sidewalls 200. FIG. 3 illustrates the spacer links 302 of a spacer 300 in a state intermediate the expanded and collapsed states, with the spacer 300 bending at the elbow ends 310 of the spacer links 302, and the protruding web portions 402 and spacer link wall ends 308 approaching each other (when collapse is occurring) or moving away from each other (when expansion is occurring).

The foregoing arrangement advantageously allows the concrete form units 100 to be shipped in a collapsed state, and rapidly converted to an expanded state at a construction site without the need for extensive assembly. The concrete form units 100 are simply unfolded from the collapsed state to the expanded state, and a larger concrete form may be assembled by affixing one concrete form unit 100 to another by stacking their top and bottom ends 202 and 204, and/or by interconnecting their side ends 206 if their side ends 206 additionally or alternatively include interlocking structure. Advantageously, when the form units 100 are collapsed, their side ends 206 are aligned in at least substantially coplanar relation (as seen in FIG. 4), so that each form unit 100 neatly fit within the space of a rectangular prism, i.e., in the space that a rectangular box would occupy. This allows substantially more forms 100 to be fit within an available shipping space than is otherwise possible with prior collapsible forms using parallelogram linkages.

Assembly of a concrete form 100 may be further assisted if some form of stabilizing means for maintaining the sidewalls 200 in the expanded state is provided, so that once the sidewalls 200 are placed in the expanded state, the spacers 300 will not inadvertently buckle. Such stabilizing means may be provided by one or more of the following measures.

First, with particular reference to FIGS. 3 and 6, the elbow ends 310 of the spacer links 302 may include stops 318 thereon, with the stops 318 protruding from the spacer links 302 at or near their sleeve bearings 312. With appropriate placement of the stops 318 on the sleeve bearings 312, so that the stops 318 begin to interfere once the transition is made between the collapsed state and the expanded state, the spacer links 302 can restrict the pivoting of the spacer links 302 about their elbow ends 310 to no more than approximately 180 degrees of rotation. Thus, the stops 318 prevent the spacer links 302 from being able to further pivot once the spacer links 302 are in at least substantially parallel and coaxial relation (i.e., in the relation illustrated in FIGS. 1 and 2). Thus, the stops 318 can ensure that the spacer links 302 may unfold to form an operational spacer 300, but unfold no further.

Second, with particular reference to FIG. 6, the wall ends 308 of the spacer links 302 may be bounded by well-defined corners 320, and the protruding web portions 402 may have engagement surfaces 412 situated between their web sleeve bearings 408, such that when the spacer links 302 are pivoted about their wall ends 308 into orientations at least substantially perpendicular to the sidewalls 200, the spacer link wall end corners 320 will click into position in relation to the engagement surfaces 412 of the webs 400. Stated differently, as the spacer links 302 are pivoted about their wall ends 308 from the collapsed state to the expanded state (a situation which may be better envisioned with reference to FIG. 3), a wall end corner 320 will first encounter and interfere with the adjacent engagement surface 412 of the web 400. However, if the spacer links 302 and webs 400 are appropriately configured and one or both of the web 400 and spacer 300 are made of plastic (or other materials with at least limited flexibility), the resistance generated by such interference may be defeated and the spacer links 302 may further pivot and "click" into the expanded state with the spacer link wall ends 308 oriented substantially parallel to the engagement surfaces 412 of the webs 400, and with the spacer links 302 overall being oriented at least substantially perpendicular to the sidewalls 200. However, further rotation of the spacer links 302 cannot be achieved without again defeating the interference between the spacer link wall end corners 320 and the web engagement surfaces 412.

Thus, with the "clicking" feature between the spacer link wall ends 308 and the sidewalls 200, and also the stops 318 at the spacer link elbow ends 310, the sidewalls 200 may be placed in the expanded state and will resist returning to the collapsed state unless a user applies sufficient force. This can be done, for example, by a user situating his/her hand between the sidewalls 200 and "chopping" each spacer 300 in the direction in which each spacer 300 bends at its elbow ends 306, so that the spacer 300 may again fold.

It can also be useful to have the stops 318 situated on the spacers 300 such that some spacers 300 have their spacer links 302 pivot about their elbow ends 310 in one direction, and the spacer links 302 of other spacers 300 pivot about their elbow ends 310 in the opposite direction. To explain in greater detail, consider FIGS. 2 and 3 wherein one of the spacers 300 in FIG. 2 pivots in the inverted "V" direction depicted in FIG. 3, but the adjacent spacer 300 is restricted to pivot in the opposite direction (in a "V" direction which mirrors the inverted "V" of FIG. 3). This can make the sidewalls 200 extremely resistant to accidental folding into the collapsed state since it is unlikely that some spacers 300 between a pair of sidewalls 200 might accidentally be displaced in one direction, whereas other spacers 300 are accidentally displaced in the other direction.

The spacers 300 preferably include several other useful features as well. Initially, looking particularly to FIGS. 2, 3, and 6, the spacer link top surfaces 304 (and the bottom surfaces as well, where the spacer links 302 have identical structure) bear pockets 322. This allows the concrete poured between the sidewalls 200 to flow and set within the pockets 322, more firmly anchoring the spacer links 302 within the set concrete. Additionally, the spacer link top surfaces 304 and/or bottom surface may include notches 324 wherein rebar may be received to better strengthen the concrete poured between the sidewalls 200 after it sets.

A preferred version of the invention is shown and described above to illustrate different possible features of the invention, and it is emphasized that modified versions are also considered to be within the scope of the invention. Following is an exemplary list of potential modifications.

First, it should be understood that the sidewalls 200, spacers 300, and webs 400 may assume a wide variety of configurations which have substantially different appearances than those of the exemplary version of the invention discussed above. As an example, the pivoting attachments between the spacer links 302 and sidewalls 200 may assume different forms. This includes variations wherein the spacer link wall ends 308 yoke into several terminals which are pivotally received between multiple web sleeve bearings 408 on the protruding web portions 302, or wherein the pivoting arrangements between the spacer link wall ends 308 and web sleeve bearings 408 are reversed, such that protrusions extending from the protruding web portions 302 are pivotally received between yoked bearings on the spacer link wall ends 308. Similarly, the spacer link elbow ends 310 may include lesser or greater numbers of pivotally connected bearings 312, and the spacer links 302 need not be identically configured. The pivoting connections between the spacer links 302, and between the spacer links 302 and webs 400, need not take the form of clevis-like arrangements wherein one member is pivotally connected between a pair of opposing bearings, and instead may simply pivotally connect single adjacent members. Additionally, pivots may be provided by arrangements other than journalled pins, such as by use of living hinges.

Second, other forms of stabilizing means apart from the stops 318, corners 320, and engagement surfaces 412 are possible. As one example, the stops 318 may take the form of latching structures wherein one of the stops 318 resiliently engages the other when the spacer links 302 achieve the expanded state, e.g., as where the stop 318 on one spacer link 302 takes the form of a male member and the stop 318 of the other bears a female aperture whereby the two engage each other and resist detachment. A similar latching arrangement may also be employed between the web bearings 408 and spacer link wall ends 308. As another example, the bearings 312 may bear a series of circumferential teeth arrayed about their elbow end bores 314 such that when a pair of spacer links 302 are joined at their elbow ends 310, their teeth engage and they rotate incrementally with respect to each other with a ratcheting action between the collapsed and expanded states, and tend to resist rotating from the position into which they are urged. The web bearings 408 and spacer link wall ends 308 may bear similar structure.

Third, while the spacers 300 and their spacer links 302 are depicted and described as pivoting about a horizontal plane oriented along the lengths of the sidewalls 200, they may pivot about other planes instead. As an example, some of all of the spacer links 302 might instead pivot in vertical planes, or with reference to FIG. 1, all spacer links 302 might all pivot in different planes so that their elbow ends all move inwardly towards the midpoint of the sidewalls 200.

Fourth, the space occupied by the form unit 100 when in its collapsed state may be further reduced by eliminating the space between the sidewalls 200 (as depicted in FIG. 4) by recessing the protruding web portions 402 and their bearings 408 beneath the plane of the sidewall inner surface 208, and also providing channels in the sidewall inner surface 208 into which the collapsed spacer links 302 may be received, so that the sidewall inner surfaces 208 rest in abutment when the form unit 100 is collapsed.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A concrete form comprising:

a. opposing sidewalls, each sidewall including webs embedded therein, wherein each web includes a protruding web portion extending out of the sidewall towards the other sidewall of the concrete form, and b. spacers extending between the sidewalls, each spacer including at least a pair of rigid spacer links, each spacer link including:

i. a wall end pivotally linked to one of the protruding web portions of a sidewall, wherein the wall end includes corners which interfere with the sidewall about which the spacer link pivots, the corners being oriented such that the spacer link clicks into an orientation at least substantially perpendicular to the sidewall and resists further pivoting from such an orientation; and ii. an elbow end pivotally linked to another of the spacer links within the spacer. wherein the sidewalls may be:

(1) expanded into spaced relationship wherein the spacer links are oriented at least substantially perpendicular to the sidewalls, or (2) collapsed into closely adjacent relationship wherein the spacer links are oriented at least substantially parallel to the sidewalls.

2. The concrete form of claim 1 wherein:

a. the elbow ends of each spacer link are yoked into at least two spaced bearings, and b. the bearings of the spacer links within each spacer are interleaved along a common axis so that each spacer link has at least one bearing received between a pair of bearings of the other spacer link within the spacer.

3. The concrete form of claim 1 wherein the elbow ends of the spacer links have stops thereon, the stops restricting the pivoting of the spacer links within each spacer to no more than approximately 180 degrees of rotation about their elbow ends.

4. The concrete form of claim 1 wherein the spacer links within each spacer may pivot no more than approximately 180 degrees about their elbow ends.

5. The concrete form of claim 4 wherein:

a. the spacer links may pivot about their wall ends into orientations at least substantially perpendicular to the sidewalls, and b. the spacer links, once oriented at least substantially perpendicular to the sidewalls, resist further pivoting.

6. The concrete form of claim 4 wherein at least one of the spacer links is restrained to pivot about its elbow end in a different direction than another one of the spacer links pivotally linked to the same sidewall.

7. The concrete form of claim 1 wherein the spacer links have identical structure.

8. The concrete form of claim 1 wherein:

a. the sidewalls of the concrete form include opposing top and bottom ends and opposing side ends situated therebetween, and b. the spacer links include top and bottom surfaces with pockets defined therein, whereby the pockets may receive concrete poured between the sidewalls.

9. Two or more of the concrete forms of claim 1, wherein:

a. the sidewalls of each concrete form include opposing top and bottom ends and opposing side ends situated therebetween, and b. the top ends of each concrete form are configured to abut the bottom ends of the sidewalls of another of the concrete forms in interlocking relationship.

10. A concrete form comprising:

a. opposing sidewalls formed of foamed plastic having embedded webs, the webs including protruding web portions extending out of the sidewalls into a space located between the sidewalls;

b. spacers extending between the sidewalls, each spacer including a pair of rigid spacer links, each spacer link within each spacer including:

(1) a wall end pivotally linked to a protruding web portion, wherein the wall end is configured to resist further pivoting once the spacer link is pivoted into at least substantially perpendicular relation to the sidewall from which the web portion protrudes;

(2) an elbow end pivotally linked to the other of the spacer links within the spacer, the elbow end including a stop thereon whereby the spacer links within the spacer may pivot approximately 180 degrees from:

(a) a collapsed state with the spacer links situated in at least substantially parallel relation, to (b) an expanded state wherein the spacer links are in at least substantially parallel relation, with the stops preventing further pivoting.

11. The concrete form of claim 10 wherein the wall ends of the spacer links include corners which interfere with the web portions to which they are pivotally linked when the spacer links are pivoted to and from orientations approximately 90 degrees from the sidewalls.

12. The concrete form of claim 10 wherein the spacer links have identical structure.

13. The concrete form of claim 10 wherein:

a. the spacer links have identical structure;

b. the elbow ends of each spacer link include at least two spaced bearings, and c. within each spacer, the sleeve bearings of the spacer links are interleaved along a common axis, with each spacer link having at least one of its bearings received between a pair of bearings within the other spacer link.

14. A concrete form comprising at least two concrete form units, each concrete form unit including:

a. opposing sidewalls, each sidewall including opposing top and bottom ends and opposing side ends situated therebetween, and wherein the top ends are configured to abut the bottom ends of the sidewalls of another of the concrete form units in interlocking relationship, and b. spacers extending between the sidewalls, each spacer including at least a pair of rigid spacer links, each spacer link including a wall end pivotally linked to a sidewall and an elbow end situated between the sidewalls and pivotally linked to another of the spacer links, the spacer links being pivotable between:

(1) a collapsed state wherein the spacer links are oriented at least substantially parallel to each other and at least substantially parallel to the sidewalls, with the sidewalls being closely adjacent, and (2) an expanded state wherein the spacer links are oriented at least substantially parallel to each other and at least substantially perpendicular to the sidewalls, with the sidewalls being in spaced relationship, and wherein the spacer links are restrained at their wall ends to remain at least substantially perpendicular to the sidewalls when pivoted into the expanded state.

15. The concrete form of claim 14 wherein within each concrete form unit:

a. the spacer links have identical structure;

b. the elbow ends of each spacer link include at least two spaced bearings, and c. within each spacer, the bearings of the spacer links are interleaved along a common axis, with each spacer link having at least one of its bearings received between a pair of bearings within the other spacer link.

16. The concrete form of claim 14 wherein the spacer links include top and bottom surfaces with pockets defined therein.

17. A concrete form comprising:

a. opposing sidewalls, each sidewall including embedded therein, the webs including protruding web portions extending out of the sidewall towards the other sidewall of the concrete form, and b. spacers extending between the sidewalls, each spacer including at least a pair of rigid spacer links, each spacer link including a wall end pivotally linked to one the protruding web portions of a sidewall and an elbow end pivotally linked to another of the spacer links within the spacer, wherein the spacer links may pivot about their wall ends into orientations at least substantially perpendicular to the sidewalls, and then resist further pivoting out of such orientations, wherein the sidewalls may be:

(1) expanded into spaced relationship wherein the spacer links are oriented at least substantially perpendicular to the sidewall, or (2) collapsed into closely adjacent relationship wherein the spacer links are oriented at least substantially parallel to the sidewalls.

18. The concrete form of claim 17 wherein the wall ends of the spacer links include corners which interfere with the sidewalls about which they pivot.

19. The concrete form of claim 17 wherein the spacer links within each spacer may pivot no more than approximately 180 degrees about their elbow ends.

20. The concrete form of claim 17 wherein the elbow ends of the spacer links have stops thereon, the stops restricting the pivoting of the spacer links within each spacer to no more than approximately 180 degrees of rotation about their elbow ends.

21. The concrete form of claim 17 wherein at least one of the spacer links is retrained to pivot about its elbow end in a different direction than another one of the spacer links pivotally linked to the same sidewall.

22. The concrete form of claim 17 wherein:

a. the elbow ends of each spacer link are yoked into at least two spaced bearings, and b. the bearings of the spacer links within each spacer are interleaved along a common axis so that each spacer link has at least one bearing received between a pair of bearings of the other spacer link within the spacer.

23. The concrete form of claim 22 wherein the spacer links have identical structure.

24. A concrete form comprising:

a. opposing sidewalls, and b. spacers extending between the sidewalls, each spacer including at least a pair of rigid spacer links, each spacer link including a wall end pivotally linked to a sidewall and an elbow end pivotally linked to another of the spacer links within the spacer, wherein the elbow ends of each spacer link branch into at least two spaced bearings, and the bearings of the spacer links within each spacer are interleaved along a common axis so that each spacer link has at least one bearing received between a pair of bearings of the other spacer link within the spacer;

wherein the sidewalls may be:

(1) expanded into spaced relationship wherein the spacer links are oriented at least substantially perpendicular to the sidewalls, or (2) collapsed into closely adjacent relationship wherein the spacer links are oriented at least substantially parallel to the sidewalls.

25. The concrete form of claim 24 wherein the spacer links resist further pivoting about their wall ends once the spacer links are oriented at least substantially perpendicular to the sidewalls.

26. The concrete form of claim 25 wherein the elbow ends of the spacer links have stops thereon, the stops restricting the pivoting of the spacer links within each spacer once the spacer links are oriented at least substantially perpendicular to the sidewalls.

27. The concrete form of claim 24 wherein the wall ends of the spacer links include corners which interfere with the sidewalls about which they pivot, the corners being oriented such that the spacer links clicks into orientations at least substantially perpendicular to the sidewalls and resist further pivoting from such orientations.

28. The concrete form of claim 24 wherein the spacer links have identical structure.

* * * * *